US011406230B2

(12) United States Patent
Stefani

(10) Patent No.: US 11,406,230 B2
(45) Date of Patent: Aug. 9, 2022

(54) DISPENSER OF WEB MATERIAL FROM ROLLS

(71) Applicant: SOFIDEL S.P.A., Porcari (IT)

(72) Inventor: Emi Stefani, Porcari (IT)

(73) Assignee: SOFIDEL S.P.A., Porcari (IT)

( * ) Notice: Subject to any disclaimer, the term of this patent is extended or adjusted under 35 U.S.C. 154(b) by 288 days.

(21) Appl. No.: 16/756,951

(22) PCT Filed: Oct. 16, 2018

(86) PCT No.: PCT/IB2018/058011

§ 371 (c)(1),
(2) Date: Apr. 17, 2020

(87) PCT Pub. No.: WO2019/077491

PCT Pub. Date: Apr. 25, 2019

(65) Prior Publication Data

US 2020/0268218 A1 Aug. 27, 2020

(30) Foreign Application Priority Data

Oct. 18, 2017 (IT) ..... 102017000117734

(51) Int. Cl.
*A47K 10/32* (2006.01)

(52) U.S. Cl.
CPC ..... *A47K 10/32* (2013.01); *A47K 2010/3253* (2013.01)

(58) Field of Classification Search
CPC ..... A47K 10/3687; A47K 2010/3253; A47K 10/32
See application file for complete search history.

(56) References Cited

U.S. PATENT DOCUMENTS 2,957,738 A * 10/1960 Marcuse ..... A47K 10/3827 225/34
3,211,504 A 10/1965 Bump
4,375,874 A * 3/1983 Leotta ..... A47K 10/38 242/598.6
6,202,956 B1 3/2001 Grasso et al.
(Continued)

FOREIGN PATENT DOCUMENTS

GB 2 454 903 * 5/2009

*Primary Examiner* — William A. Rivera
(74) *Attorney, Agent, or Firm* — McGlew and Tuttle, P.C.

(57) ABSTRACT

The dispenser (2) comprises a housing (3) where the following are provided: a first seat (5) for a first roll (R1) of web material (N1), provided with a first dispensing opening (21) for dispensing web material (N1); a second seat (7) for a second roll (R2) of web material, (N2), provided with a second dispensing opening (23) for dispensing web material (N2). A closing member (31) is mounted on the housing and is suitable to take selectively two positions with respect to the housing (3). In a first position the closing member (31) prevents access to the second dispensing opening (23) and allows access to the first dispensing opening (21). In the second position the closing member (31) prevents access to the first dispensing opening (21) and allows access to the second dispensing opening (23). A blocking member (43) is also provided, preventing the closing member (31) from moving from the first position to the second position when a roll (R1) is contained in the first seat (5).

17 Claims, 4 Drawing Sheets

(56) References Cited

U.S. PATENT DOCUMENTS

| | | | | |
|---|---|---|---|---|
| 7,083,138 | B2 * | 8/2006 | Elliott | A47K 10/3836 242/597.5 |
| 11,058,264 | B1 * | 7/2021 | Cohen | A47K 1/08 |
| 2006/0038054 | A1 | 2/2006 | Tramontina et al. | |
| 2007/0290094 | A1 | 12/2007 | Anderson | |
| 2008/0087759 | A1 * | 4/2008 | Cittadino | A47K 10/36 242/598.6 |
| 2018/0249869 | A1 * | 9/2018 | Wright | A47K 10/38 |
| 2020/0305656 | A1 * | 10/2020 | Landa | A47K 10/3687 |

* cited by examiner

DISPENSER OF WEB MATERIAL FROM ROLLS

TECHNICAL FIELD

The present invention relates to improvements to the web material dispensers. Embodiments described herein relate in particular to a dispenser of web material from rolls, for example tissue paper (such as toilet paper, kitchen towels and the like) from rolls.

STATE OF THE ART

Tissue paper, for instance toilet paper, kitchen towels and the like, is usually packed in rolls destined to consumption. The rolls are usually arranged in a dispenser, from which the user can take the paper. Many different types of dispensers have been designed, for domestic and industrial use, to be used in workplaces, public premises and the like.

One of the problems of these dispensers, above all when used in workplaces or public places, where the consumption is significant, is the need of promptly replacing exhausted rolls. Dispensers have been studied that are adapted to contain more rolls in order to extend the time interval between a filling of the dispenser and the subsequent filling.

Some dispensers of this type are particularly complex and expensive. Other dispensers cause an excessive consumption of material, above all when used in public places, where many users access the dispensers.

Tissue paper rolls are usually produced by winding a tissue paper sheet around a tubular winding core. The core defines a central hole in the roll and allows introducing the roll in a dispenser having a support pin that can be inserted inside the tubular core. Recently, rolls have been marketed without tubular winding core, which have many advantages, as they avoid the need for using cardboard for producing the winding cores and also allow to produce rolls that, given the same overall space, contain a greater amount of useful paper. However, these rolls without tubular winding core have some difficulties when dispensed. In fact, it is not possible to use dispensers that require rolls with a through axial hole.

It would be useful to provide a dispenser for tissue paper or, in general, web material wound in roll, which completely or partially overcome one or more of the drawbacks of the prior art dispensers.

SUMMARY

According to an aspect, a dispenser of web material wound in rolls is provided, comprising a housing, where the following are provided: a first seat for a first roll of web material and a second seat for a second roll of web material. Each seat is provided with a respective dispensing opening for dispensing web material. In this way, the dispenser allows to arrange two rolls of web material, for example tissue paper, in the same housing. In embodiments described herein, a closing member is also provided, adapted to take selectively two positions with respect to the housing. In the first position the closing member prevents access to the second dispensing opening and allows access to the first dispensing opening. In the second position the closing member prevents access to the first dispensing opening and allows access to the second dispensing opening. In this way the user is forced to fully use the first roll before accessing the second roll.

In order to prevent the user from getting access to the paper, or other web material, of the second roll before the first roll has been finished, a blocking member is advantageously provided, preventing the closing member from moving from the first position to the second position when a roll is contained in the first seat. The second dispensing opening can be accessed only when the first roll has been finished. In this way, paper wastes are avoided and the consumption is optimized.

In some embodiments, the closing member can be constituted by, or can form, a door, for example a sliding door.

The blocking member, comprising or constituted by a door, may comprise an appendix integral with the closing member, wherein the appendix can enter in the first seat when the closing member is moved from the first position to the second position. The movement is prevented when in the first seat there is a partially consumed roll. To this end, for example, the dimension of the appendix can be such to interfere with a roll placed in the first seat when the closing member is moved from the first position to the second position.

The door can have a transparent window, which allows checking the presence and the level of consumption of the rolls in the first and/or in the second seat.

In advantageous embodiments, the first seat and the second seat are arranged adjacent to one another in the housing. The first seat and the second seat can be horizontally or vertically aligned. The "horizontal" and "vertical" orientation refers to the position of the dispenser during the normal use thereof.

The dispenser can be configured so as to be applied to a wall, but it is also possible to provide a dispenser that can rest on a shelf or on a floor.

In some embodiments, the closing member is elastically biased in the first position, for example by means of springs, especially traction springs, or other elastic members. In this way, the closing member is moved from the first position to the second position against the elastic force. Blocking members can be provided for blocking the closing member in the second position against the return force generated by the traction springs or other elastic members.

In some embodiments, the housing of the dispenser can comprise two parts that are coupled together and can be opened to access the inside of the first seat and of the second seat. For example, two parts can be hinged together and can have a closing mechanism, for example a key mechanism.

For example, a first one of the two parts of the housing can comprise fastening members for fastening to a bearing structure. In some embodiments, the fastening members can comprise holes, slots or other means for engaging wall-mounted hooks. The dispensing openings can be provided on the second part of the housing.

One of the two parts forming the housing can form a sliding guide for the closing member. For example, the closing member can be in form of a door sliding along a guide mechanism formed by one of the two parts of the housing.

The two seats for the rolls can be formed mainly in one of the two parts of the housing, whilst the other part forms a sort of closing lid. In embodiments described herein, rest surfaces for the two seats for the rolls can be integral with one of the two parts of the housing. The rest surfaces allow retaining in the seats rolls without tubular winding core.

The rest surfaces can be inclined so as to cause a roll to move along the respective rest surface away from the respective dispensing opening by rolling under the effect of gravity. In this way, the contact point between roll and rest surface remains at the maximum distance from the dispensing opening. In this way it is possible to avoid that, while dispensing the web material, the web material tears at a point far from the dispensing opening, which cannot be reached by the user to grip the edge of web material remained on the roll.

In some embodiments, the closing member forms a slider arranged outside the housing, for example outside one part of the two coupled parts defining the housing, on which part the first dispensing opening and the second dispensing opening are provided. The slider can be slidingly guided along the housing. The slider can form a door for selectively closing the one and the other of said first dispensing opening and second dispensing opening. The slider can have a U-shaped elastically deformable cross section, and can have, along opposite edges thereof, constraint members co-acting with blocking elements integral with the housing. The constraint members can couple the slider to the blocking members to keep it fixed in one or in the other of the two possible positions, for example in the second position, whilst elastic members tend to bias the slider towards the first position.

Further advantageous features and embodiments of the dispensing according to the present invention are set forth hereunder and in the attached claims, which form an integral part of the present description.

BRIEF DESCRIPTION OF THE DRAWINGS

The invention will be better understood by following the description and the accompanying drawing, which shows a non-limiting exemplary embodiment of the invention. More in particular, in the drawing.

DETAILED DESCRIPTION

The detailed description below of example embodiments is made with reference to the attached drawing. The same reference numbers in different figures identify equal or similar elements. Moreover, the drawings are not necessarily to scale. The detailed description below does not limit the invention. The protective scope of the present invention is defined by the attached claims.

In the description, the reference to "an embodiment", "the embodiment" or "some embodiments" means that a particular feature, structure or element described with reference to an embodiment is comprised in at least one embodiment of the described object. The sentences "in an embodiment" or "in the embodiment" or "in some embodiments" in the description do not therefore necessarily refer to the same embodiment or embodiments. The particular features, structures or elements can be furthermore combined in any adequate way in one or more embodiments.

Figure 3:
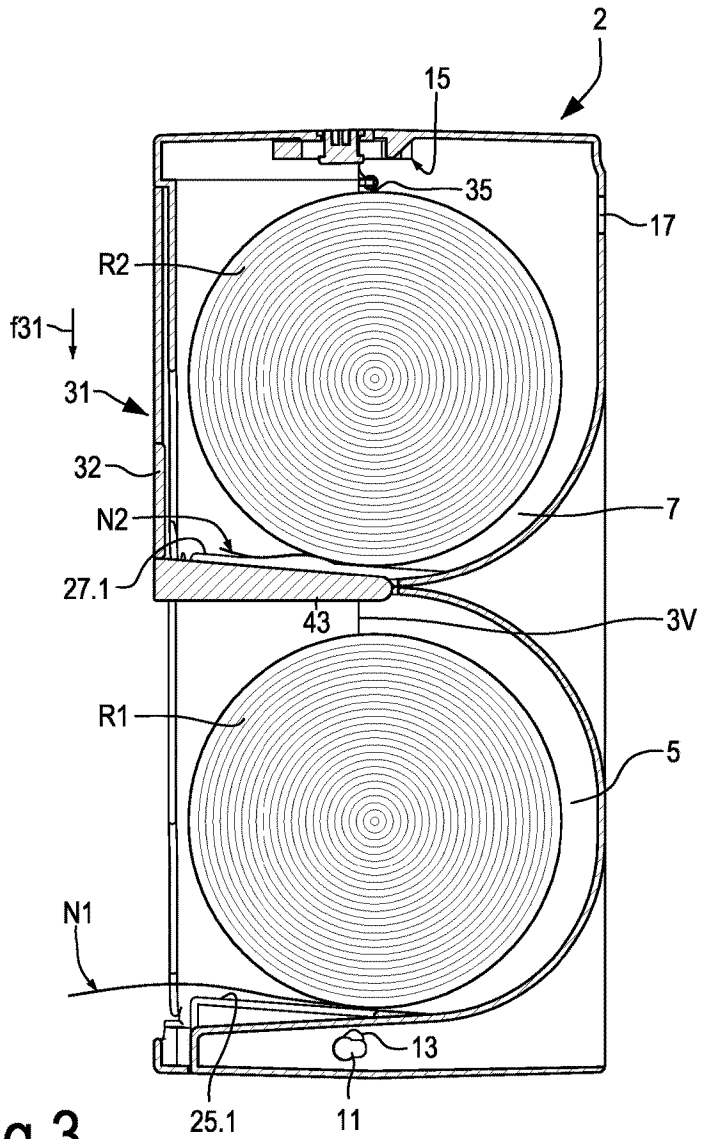
FIG. 3 is a section according to III-III of FIG. 2, in a condition where there is a roll in each seat of the dispenser.
Figure 4:
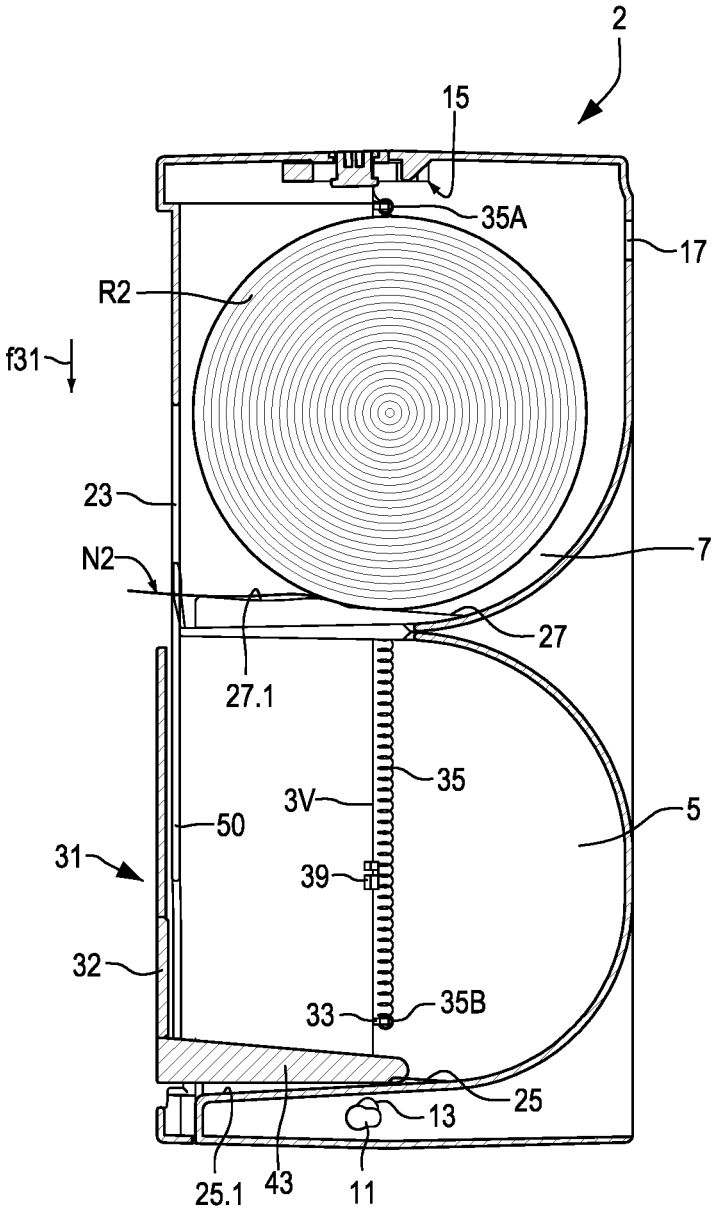
FIG. 4 shows a cross section similar to that of FIG. 3, wherein one of the two seats is empty and the other contains a roll.

The dispenser 2 comprises a housing 3, inside which two seats can be provided for two rolls of web material, for example rolls of toilet paper. FIGS. 3 and 4 show a first seat 5 and a second seat 7. In the illustrated embodiment, the seats 5 and 7 are adjacent and vertically aligned to each other. In other embodiments, not shown, the seats can be horizontally adjacent.

R1 and R2 indicate a first roll and a second roll, for example of toilet paper. The first roll R1 is formed by a first wound web material N1 and the second roll R2 is formed by a second wound web material N2. In the illustrated embodiment, the rolls R1 and R2 are without winding central core.

Figure 5:
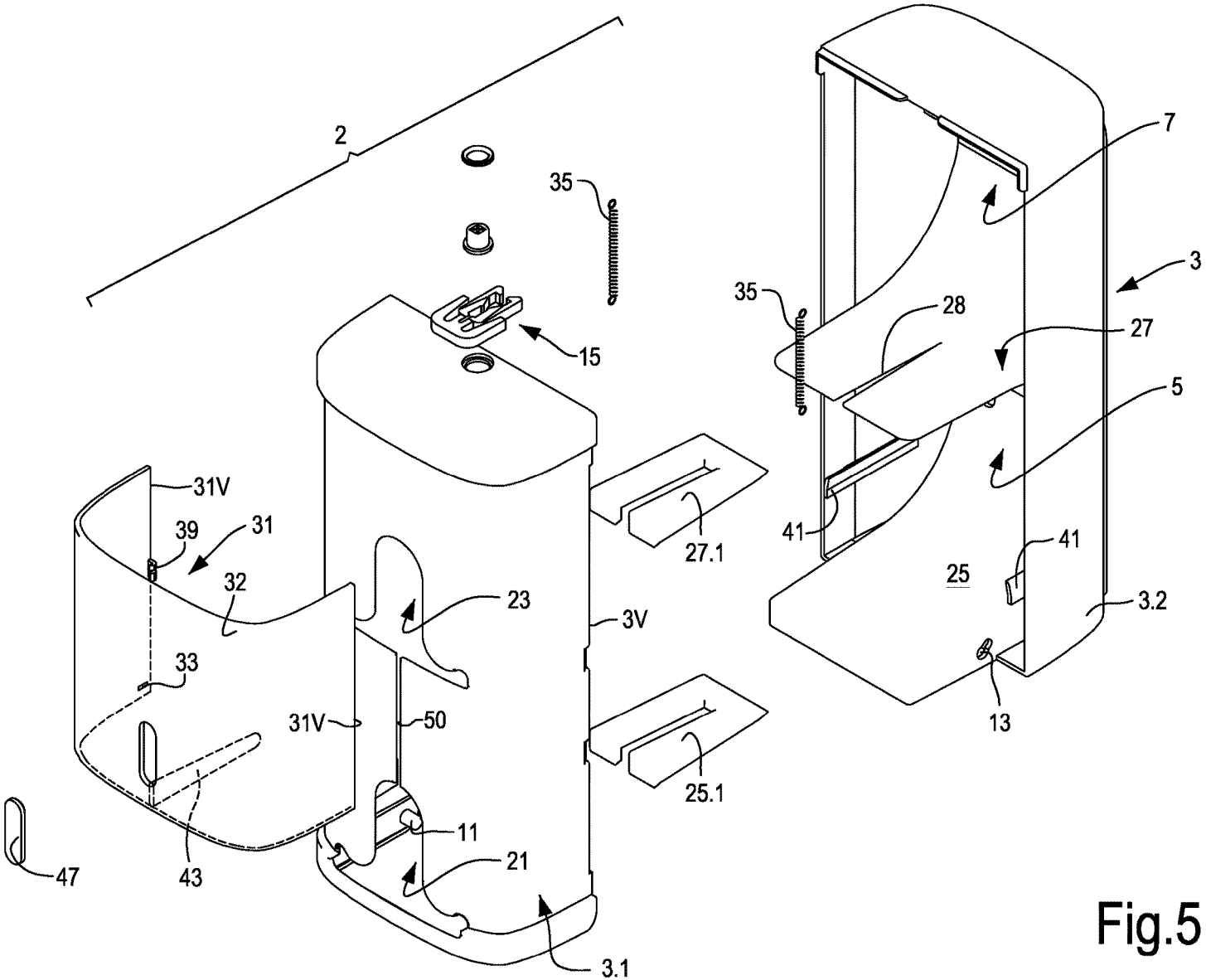
FIG. 5 is an exploded view of the dispenser.

The housing 3 may be formed by two parts 3.1 and 3.2, see in particular FIG. 5. The two parts 3.1 and 3.2 can be connected to one another, so as to allow opening and closing of the housing without completely separating the two parts, however allowing access to the two seats 5 and 7 in order to insert respective rolls R1, R2 therein.

For instance, the two parts 3.1 and 3.2 can be hinged together around a rotation axis A-A. In the illustrated embodiment, the rotation axis A-A is horizontal.

The part 3.1 may have pivot pins 11 and the second part 3.2 may have holes 13 where the pins 11 are inserted. The rotation axis A-A can be positioned in the lower part of the housing 3. In order to keep the two parts 3.1 and 3.2 in closed position, a lock 15 or other closing member can be provided for example a simple hook, an elastic tab to other constraint means, that can be arranged in the upper part of the housing 3.

The part 3.2 of the housing 3 can be configured with fastening members for fastening to a wall or other bearing structure. For example, holes 17 can be provided on the rear wall of the part 3.2, for wall-mounting screws. One of the holes 17 is shown just by way of example in FIGS. 3 and 4.

The part 3.1 of the housing 3 forms a first dispensing opening 21 and a second dispensing opening 23 arranged at the first seat 5 and at the second seat 7 for the rolls R1 and R2, respectively. Each opening can have a lower part of greater width to allow the passage of the web material N1, N2, and an upper part allowing to insert a finger inside the housing 3 in order to take the leading edge of the web material if, following tear or breakage thereof, the leading edge of the web material remains inside the respective seat 5 or 7.

The first seat 5 may have a rest surface 25 for the roll R1 and the second seat 7 may have a rest surface 27 for the second roll R2. The first rest surface 25 may be partly formed by a slide 25.1 and the second rest surface 27 may be partly formed by a slide 27.1. For constructional purposes, as shown in the exploded view of FIG. 5, the slides 25.1 and 27.1 can be formed as pieces separated from a unit forming the part 3.1 of the housing 3 and part of the rest surface 25, 27.

As clearly apparent in particular from the cross-sections of FIGS. 3 and 4, the portions of rest surface formed by the slides 25.1 and 27.1 can be advantageously slightly inclined downwards from the respective dispensing opening and towards the rear or inner part of the seats 5 and 7, so that the respective rolls R1 and R2 tend to move away from the dispensing openings 21 and 23 by rolling under the effect of gravity, to rest in the back part of the seats 5 and 7, away from the dispensing openings.

The dispenser 2 comprises a closing member 31 configured so as to close selectively one or the other of the two dispensing openings 21 and 23. The closing member 31 is shown in particular in the exploded view of FIG. 5, where it is shown isolated from the housing 3.

Figure 1:
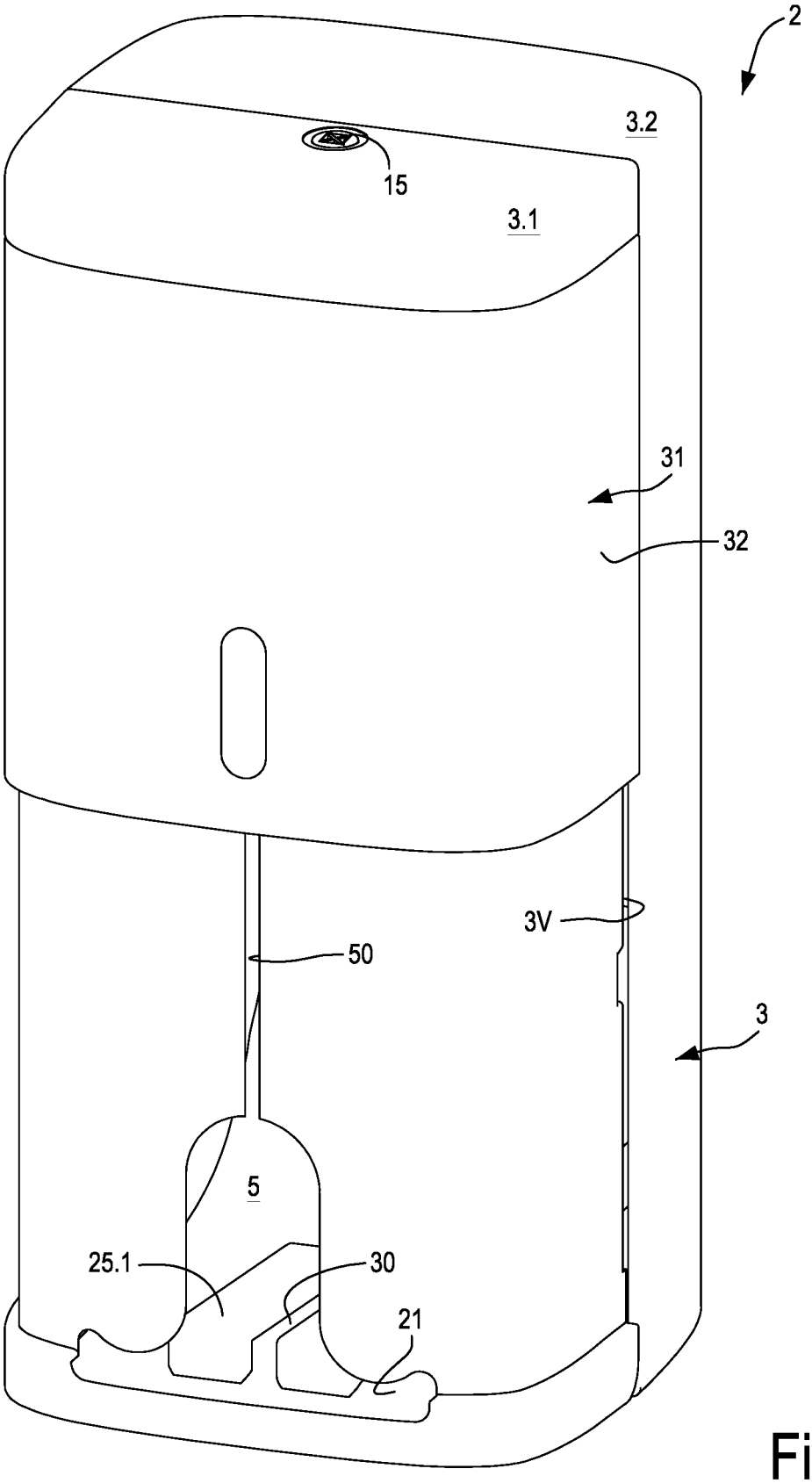
FIG. 1 is an axonometric view of a dispenser.
Figure 2:
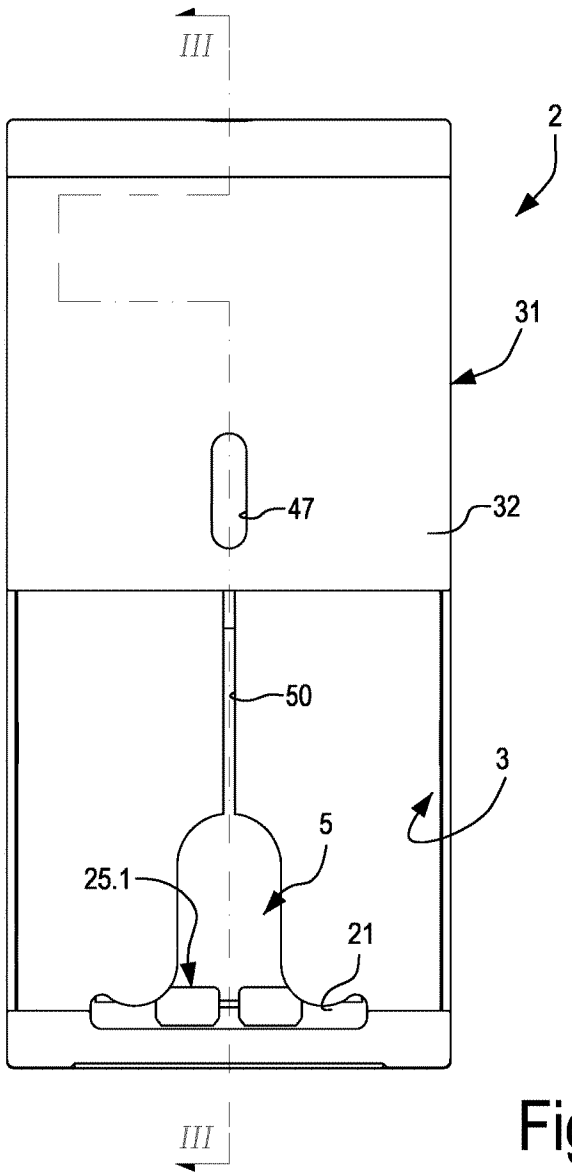
FIG. 2 is a front view of the dispenser of FIG. 1.

In the illustrated embodiment, the closing member 31 forms a door 32, in particular a sliding door, and has a U-shaped cross-section. Hooks 33 for tractions springs 35 are provided along the vertical edges 31V of the door 32. One of the traction springs is visible in particular in FIG. 4. Each traction spring 35 has a first end 35A fastened to the part 3.1 of the housing 3, and a second end 35B fastened by means of the hook 33 to the respective vertical edge 31V of the door 32. The traction springs 35 apply a lifting force to the door 32, the lifting force forcing the door to take the position shown in FIGS. 1, 2 and 3.

The hook 33 along each vertical edge 31V of the door 32 forms also an engaging and guiding element for the door 32 along vertical edges 3V of the part 3.1. Further guiding elements can be provided in 39.

Moreover, the hooks 33 have also the function of constraint members co-acting with blocking elements 41 integral with the second part 3.2 of the housing 3. Thanks to the elasticity of the door 32 with U-shaped cross-section, the door can slide downwards against the action of the traction springs 35 so as to snap the hooks 33 under blocking elements 41, so as to keep the door 32 in the position illustrated in FIG. 4, against the return action of the traction springs 35.

The door 32 carries a blocking member 43 for the purposes described below, which, in certain conditions, prevents the lowering movement of the door 32. In the illustrated embodiment, the blocking member 43 is constituted by, or comprises, an appendix substantially orthogonal to the door 32, and more precisely to the front portion of the door, which selectively closes one or the other of the two dispensing openings 21 and 23.

As shown in particular in the cross-sections of FIGS. 3 and 4, the appendix 43 extends towards the inside of the housing 3 for such a length as to interfere with a roll R1 arranged in the seat 5.

The function of the appendix 43 forming a blocking member for the door or closing member 31 can be easily understood by comparing FIGS. 3 and 4. In the arrangement of FIG. 3, two rolls R1 and R2 are arranged in the respective seats 5 and 7. The door 32 is in a first position, in which it allows access to the first dispensing opening 21, but prevents access to the second dispensing opening 23. The user can take the web material N1 through the first dispensing opening 21 by unwinding it from the first roll R1, but cannot access the second roll R2. If the user tries to move the door 32 downwards to access the roll R2 that is in the seat 7, the movement of the door 32 is prevented by the interference between the appendix 43 and the first roll R1 that is in the seat 5.

In this position the appendix 43 extends towards the inside of the housing 3 thanks to the presence of a slot 28 provided in the slide 27.1 and in the rest surface 27 of the roll R2 in the second seat 7.

Accessing the second dispensing opening 23 is possible only when the first roll R1 has been finished. In this condition, the door 32 can be moved downwards according to the arrow f31 (FIG. 3), against the traction force of the springs 35, until the hooks 33 snap under the blocking elements 41. In this way, the position shown in FIG. 4 is achieved. Now, the user can access the second roll R2 and take therefrom the web material N2 through the second dispensing opening 23.

The downward movement of the door 32 and of the appendix 43 is allowed, in particular, by the presence of a vertical slot 50 provided on the outer front wall of the housing 3 and extending from the first dispensing opening 21 to the second dispensing opening 23.

In the illustrated embodiment, the door 32 has, at the front, a window 47, made for example of transparent material, allowing to see the one or the other of the two seats 5, 7. In this way, an operator who shall fill the dispenser 2 can quickly verify whether in one or the other of the two seats 5, 7 there is no roll.

The invention claimed is:

1. A dispenser for dispensing web material wound in rolls, the dispenser comprising:

a housing comprising a first seat for a first roll of first web material, a first dispensing opening for dispensing the first web material, a second seat for a second roll of second web material and a second dispensing opening for dispensing the second web material;

a closing member configured to take selectively two positions with respect to the housing, wherein in the first position the closing member prevents access to the second dispensing opening and allows access to the first dispensing opening, wherein in the second position the closing member prevents access to the first dispensing opening and allows access to the second dispensing opening;

a blocking member preventing the closing member from moving from the first position to the second position when the first roll is contained in the first seat, the first seat and the second seat being arranged one over another vertically when the dispenser is in a use position, the first seat comprising a first rest surface for the first roll and the second seat comprising a second rest surface for the second roll, the first rest surface being inclined such that the first roll is movable away from the first dispensing opening by rolling via gravity and the second rest surface being inclined such that the second roll is movable away from the second dispensing opening by rolling via gravity, the second seat having a slot in the second rest surface thereof for allowing the blocking member to pass when the closing member moves from the first position to the second position.

2. The dispenser of claim 1, wherein the closing member comprises a sliding door.

3. The dispenser of claim 2, wherein the closing member comprises an appendix integral with the closing member and the appendix extends therefrom towards an inside of the housing, the appendix being movable in the first seat when the closing member is moved from the first position to the second position, wherein the appendix extends orthogonally from the sliding door.

4. The dispenser of claim 1, wherein the closing member comprises an appendix integral with the closing member and the appendix extending therefrom towards an inside of the housing, wherein the appendix is movable in the first seat when the closing member is moved from the first position to the second position.

5. The dispenser of claim 4, wherein a dimension of the appendix is such that the appendix interferes with the first roll placed in the first seat when the closing member is moved from the first position to the second position.

6. The dispenser of claim 1, wherein the first seat and the second seat are arranged side by side.

7. The dispenser of claim 1, wherein the closing member is elastically biased in the first position and blocking elements are provided for blocking the closing member in the second position.

8. The dispenser of claim 1, wherein the housing comprises two parts coupled together and the two parts are openable to access an inside of the first seat and the second seat.

9. The dispenser of claim 8, wherein the two parts of the housing are hinged together.

10. The dispenser of claim 8, wherein one of the two parts of the housing comprises fastening members for fastening to a bearing structure, wherein the first dispensing opening and the second dispensing opening are arranged on another one of the two parts of the housing.

11. The dispenser of claim 10, wherein the another one of the two parts of the housing carries the closing member and the another one of the two parts forms a guiding system for movement of the closing member.

12. The dispenser of claim 10, wherein the one of the two parts of the housing comprising fastening members for fastening to the bearing structure forms the first rest surface and the second rest surface for the first roll and the second roll in the first seat and in the second seat.

13. The dispenser of claim 8, wherein the closing member forms a slider arranged outside one part of the two parts of the housing, the one part of the two parts comprising the first dispensing opening and the second dispensing opening, wherein the slider is slidingly guided along the one part of the two parts of the housing.

14. The dispenser of claim 13, wherein the slider forms a door for selectively closing one of the first dispensing opening and the second dispensing opening and another one of the first dispensing opening and the second dispensing opening.

15. The dispenser of claim 13, wherein a cross-section of the slider is U-shaped and elastically deformable and the slider has, along opposite edges thereof, constraint members for fastening to blocking elements of the closing member in the second position.

16. The dispenser of claim 1, wherein the first dispensing opening and the second dispensing opening are provided in a wall of the housing, wherein a slot (50) is provided in the wall, the slot extending from the first dispensing opening and from the first seat to the second dispensing opening and to the second seat, wherein the blocking member extends through the slot.

17. A dispenser for dispensing web material wound in rolls, the dispenser comprising:

a housing comprising a first seat for a first roll of first web material, a first dispensing opening for dispensing the first web material, a second seat for a second roll of second web material and a second dispensing opening for dispensing the second web material, the first seat comprising a first rest surface configured to retain the first roll without a tubular winding core and the second seat comprising a second rest surface configured to retain the second roll without a tubular winding core, wherein the first rest surface is inclined such that the first roll is movable away from the first dispensing opening by rolling via gravity and the second roll is movable away from the second dispensing opening by rolling via gravity;

a closing member configured to take selectively two positions with respect to the housing, wherein in the first position the closing member prevents access to the second dispensing opening and allows access to the first dispensing opening, wherein in the second position the closing member prevents access to the first dispensing opening and allows access to the second dispensing opening;

a blocking member preventing the closing member from moving from the first position to the second position when the first roll is contained in the first seat, wherein the housing comprises two parts coupled together and the two parts are configured to be opened to access an inside of the first seat and the second seat, one of the two parts of the housing comprising fastening members for fastening to a bearing structure, the first dispensing opening and the second dispensing opening being arranged on another one of the two parts of the housing, the another one of the two parts of the housing carrying the closing member and the another one of the two parts forming a guiding system for movement of the closing member.

* * * * *